US005125568A

United States Patent [19]

Bauer

[11] Patent Number: 5,125,568

[45] Date of Patent: Jun. 30, 1992

[54] STACKING TRAY

[75] Inventor: William C. Bauer, Baltimore, Md.

[73] Assignee: Westvaco Corporation, New York, N.Y.

[21] Appl. No.: 822,458

[22] Filed: Jan. 16, 1992

[51] Int. Cl.[5] ..... B65D 5/20

[52] U.S. Cl. ..... 229/172; 229/191; 229/918; 229/919; 229/DIG. 11

[58] Field of Search ..... 229/172, 173, 178, 915, 229/918, 919, DIG. 11, 191

[56] References Cited

U.S. PATENT DOCUMENTS

| | | | |
|---|---|---|---|
| 3,375,967 | 4/1968 | Robinson | 229/191 |
| 3,820,706 | 6/1974 | Gibson et al. | 229/DIG. 11 |
| 4,266,714 | 5/1981 | Crane | 229/DIG. 11 |
| 4,702,409 | 10/1987 | Osborne | 229/125 |
| 4,770,339 | 9/1988 | Weimer | 229/DIG. 11 |
| 4,860,948 | 8/1989 | Hofstede | 229/DIG. 11 |
| 4,911,355 | 3/1990 | Bannister | 229/DIG. 11 |

FOREIGN PATENT DOCUMENTS

| | | | |
|---|---|---|---|
| 1439175 | 4/1966 | France | 229/DIG. 11 |
| 1456917 | 9/1966 | France | 229/DIG. 11 |
| 2223988 | 10/1974 | France | 229/DIG. 11 |
| 927863 | 6/1963 | United Kingdom | 229/918 |
| 960713 | 6/1964 | United Kingdom | 229/918 |
| 964940 | 7/1964 | United Kingdom | 229/DIG. 11 |

*Primary Examiner*—Gary E. Elkins

[57] ABSTRACT

A stackable tray is formed from a single blank of cut and scored corrugated paperboard or the like with a substantially rectangular bottom panel, cut away side walls reinforced with extra panels that extend over the bottom panel and reinforced end panels that are adhered to the end walls. The reinforced end panels include score lines on alternative sides of the blank which automatically produce integral corner posts for the tray when the panels are folded and adhered to the end walls. The reinforcing panels for the end walls also include locking tabs which cooperate with locking slots in the tray bottom panels when a series of trays are stacked one upon the other.

9 Claims, 3 Drawing Sheets

Figure 5
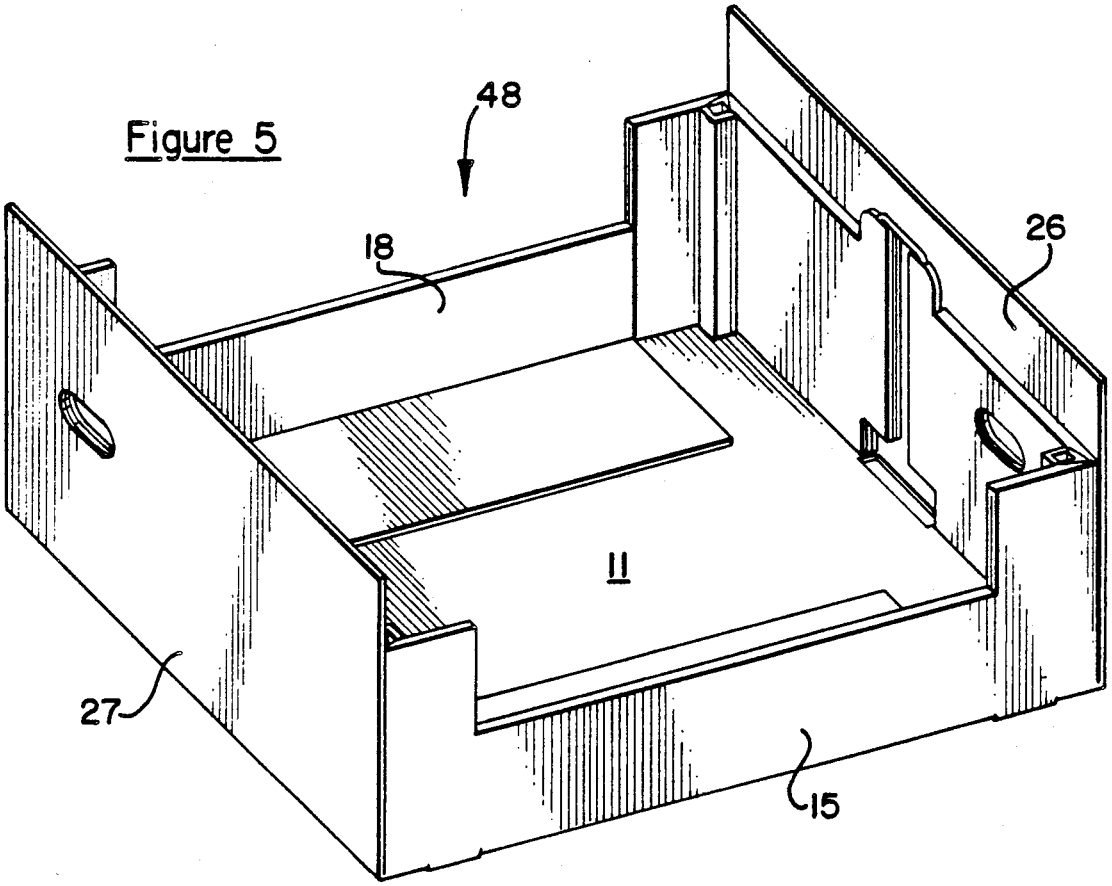
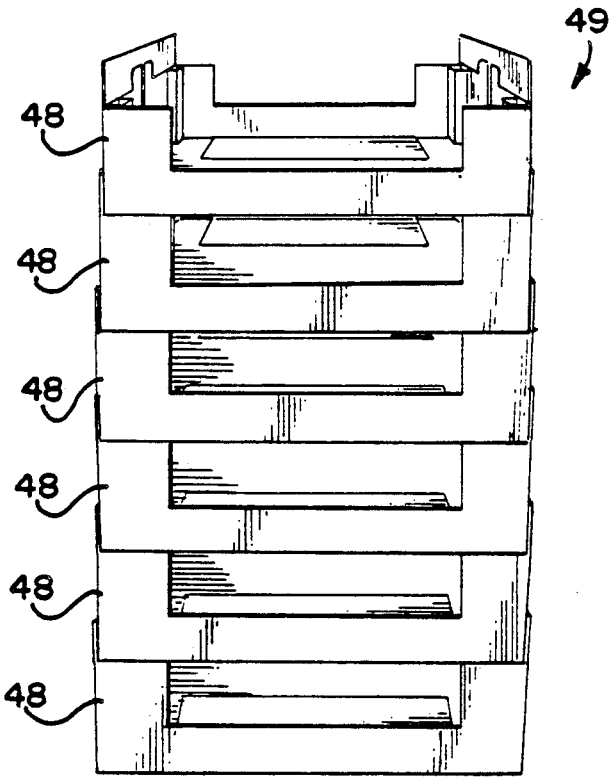
Figure 6

STACKING TRAY

BACKGROUND OF THE INVENTION

The present invention relates generally to trays prepared from corrugated paperboard and more particularly to a reinforced paperboard tray that is stackable for use as a parts bin, storage container or point of purchase display. Such trays may be formed at the factory where they are collapsed for shipment and then merely folded for set up at the point of use or they may actually be constructed at the point of use. The present invention relates to such a tray that maybe constructed at the point of use with adhesive or the like, or that may be constructed at the point of manufacture and shipped in a set up condition.

SUMMARY OF INVENTION

The present invention relates to a stackable tray prepared from corrugated paperboard having a substantially rectangular bottom panel, side walls extending upwardly from two opposed sides of the bottom panel and end walls extending upwardly from the remaining opposed sides of the bottom panel. Each of the side walls include a recessed portion located substantially centrally thereo with integrally attached reinforcing panels, one of which is preferably adhered to the inner face of the side wall and the other of which rests on top of the bottom wall. Additional end wall reinforcing panel sets are provided at each corner of the blank which are connected to the ends of the side walls. The end wall reinforcing panels are folded over upon themselves at each corner and are then folded inwardly to lie inside the end walls where they are adhered thereto for extra strength. The innermost panel of each end wall reinforcing panel set includes scored lines alternately applied to the inner and outer surfaces of the blank which automatically allow the scored portions of the inner most panels to form integral corner posts when the tray is set up. The end wall reinforcing panel sets also include locking tab elements on the upper ends thereof which cooperate with locking slots applied to the bottom wall of each tray to interlock the trays together and maintain their stability when they are stacked for use. The recessed portions of the side walls of each tray provide access to the trays when they are stacked.

Accordingly it is an object of the present invention to provide a reinforced stackable tray which is set up and glued at the point of use.

It is another object of the present invention to provide in such a package integral corner posts which are automatically formed when the reinforcing panels are folded into position for gluing.

It is yet another object of the present invention to provide a tray construction with cut away side walls for permitting access to the trays in a stacked condition and to provide means for effectively locking the stacked trays together to produce a rigid unit in use. These and other desirable objects and features will become apparent from the accompanying drawing and detailed description.

DESCRIPTION OF DRAWING

FIG. 5 is a perspective view showing the finished tray; and,

FIG. 6 is a perspective view showing a series of trays stacked one upon the other.

DETAILED DESCRIPTION

Figure 1:
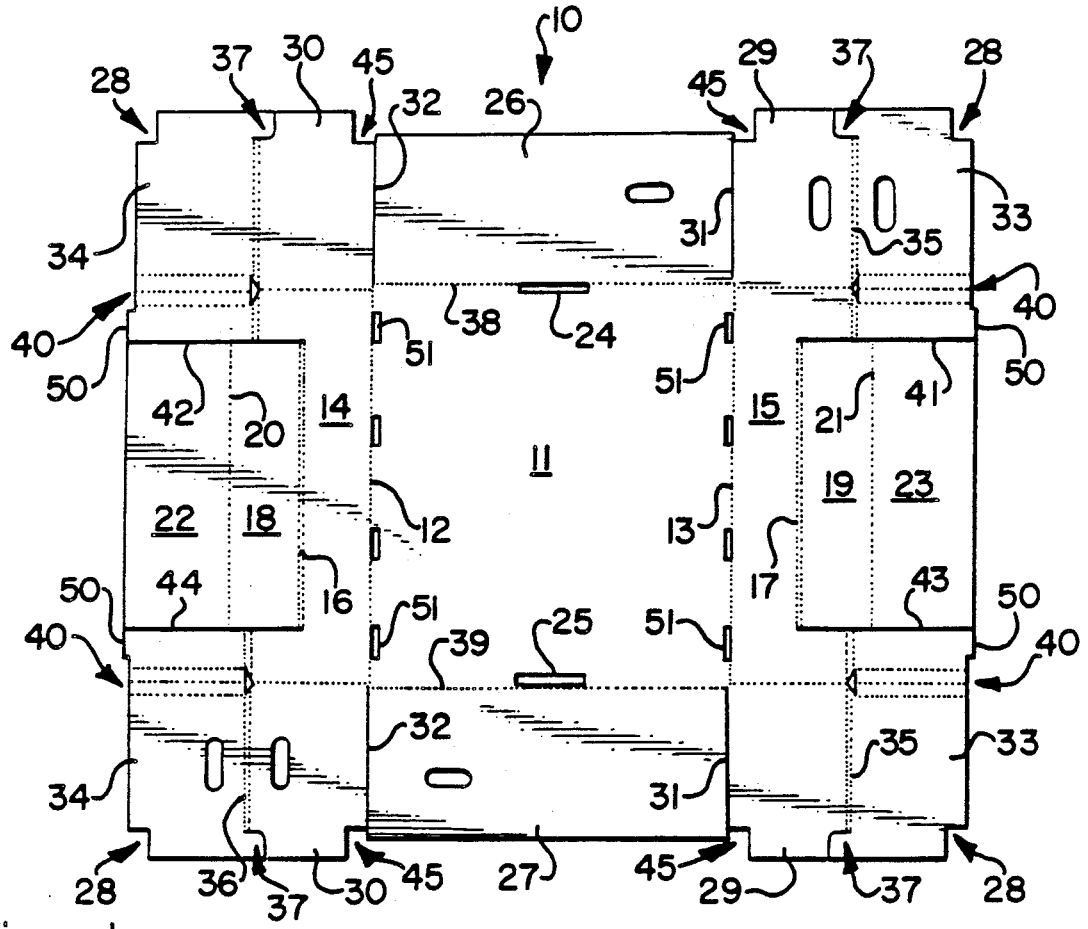
FIG. 1 is a plan view of a typical blank structure for use in preparing the tray of the present invention.

FIG. 1 illustrates a typical blank structure for use in constructing the tray of the present invention. The blank 10 includes a substantially rectangular bottom panel 11, two side walls 14, 15 foldably attached to opposite sides of the bottom panel along fold lines 12 and 13, and a pair of end walls 26, 27 foldably attached to the remaining opposite ends of the bottom panel along fold lines 38 and 39. In addition to these elements the side walls 14, 15 also include reinforcing panels foldably attached thereto. First reinforcing panels 18 and 19 are foldably attached to panels 14 and 15 along score lines 16 and 17 respectively and second reinforcing panels 22 and 23 are foldably attached to panels 18 and 19 respectively along score lines 20 and 21. Panels 18 and 19 are provided as reinforcing elements for the side walls 14 and 15, and panels 22 and 23 reinforce the bottom panel 11 when the tray is formed. During the forming process, reinforcing panel 18 is preferably adhered to side wall 14 and panel 19 is adhered to side wall 15.

At each corner of the blank 10, additional panels are provided for reinforcing the ends of the tray and for accommodating the stacking function. Since the reinforcing panels at each end of the tray are identical, only those located at one end will be described. For this purpose, a first pair of end wall reinforcing panels 29, 30 are separated from the end wall 26 by cut lines 31, 32 and are connected to the side walls 14, 15 by extensions of score line 38. A second pair of end wall reinforcing panels 33, 34 are foldably connected to panels 29, 30 along score lines 35, 36. Each of the second pair of end wall reinforcing panels 33, 34 include integral tab elements 37 while the panels 29, 30 include notched corners 45 and the panels 33, 34 include notched corners 28. The corner notches 28, 45 and the tab elements 37 each play a role in the stacking function of the tray. Furthermore, reinforcing panels 33, 34 are divided into three parts by a set of scored lines 40 which are arranged substantially in alignment with the scored lines 38, 39 to provide integral corner posts for the tray when it is formed. The integral corner posts also play a sgnificant role in the stacking function of the tray. Finally, the blank 10 also includes offset handhold cut outs in the end walls 26, 27 and the end wall reinforcing panels 29, 33 and 30, 34, and slots 24, 25 in the bottom wall 11 substantially aligned with the score lines 38, 39.

Figure 2:
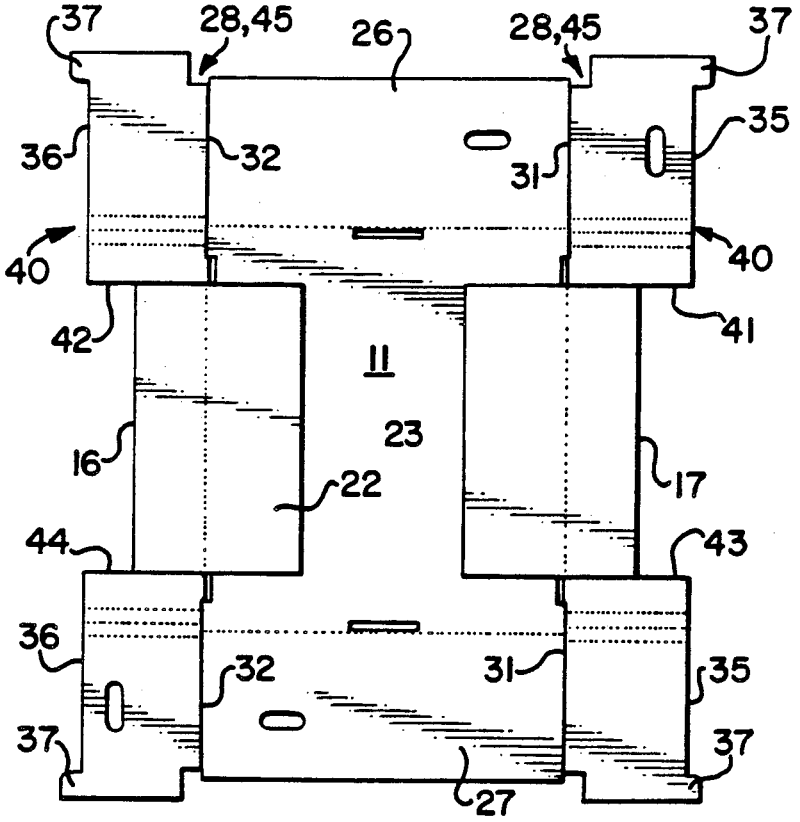
FIG. 2 is a plan view of the blank of FIG. 1 showing a first folding step.
Figure 3:
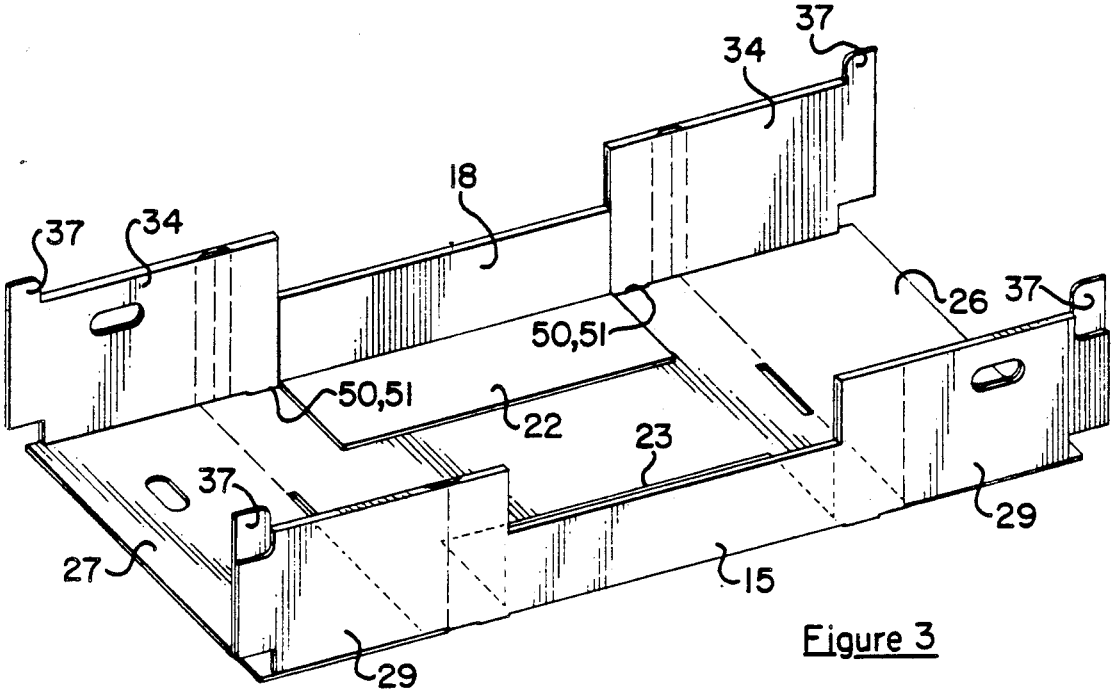
FIG. 3 is a perspective view of the blank of FIG. 1 showing a second folding step.

FIG. 2 illustrates a first step in the forming sequence for erecting the tray. The side wall reinforcing panels 18, 22 and 19, 23 are folded over about score lines 16 and 17 respectively and the end wall reinforcing panels 29, 33 and 30, 34 at each corner of the blank are folded over about score lines 35, 36. In the preferred embodiment, the side wall reinforcing panels 18 and 19 respectively are adhered to the side wall panels 14 and 15. This step causes the end wall reinforcing panel sets at each corner to automatically be raised when the combined walls 14, 18 and 15, 19 are folded into an upright condition with respect to the bottom wall. This is assured by sizing the reinforcing panels 18, 19 so that they have the same height between score lines 16, 20 and 17, 21 as the height of the side walls 14, 15 between score lines 12, 15 and 13, 14 as shown in FIG. 3. This also occurs because panels 29 and 30 are connected to side walls 14 and 15. In this position, the handhold cutouts in panels 29 and 33 at one end of the blank are aligned as are the cutouts in panels 30, 34 at the other end of the blank while the panels 34, 34 and 33, 33 at each end of the blank lie inside the panels 30, 30 and 29, 29. At the same time, the tabs 50 on the outer edges of panels 33, 34 adjacent to cut lines 41, 42, 43 and 44 are inserted in the slots 51 in the base panel 11 to hold the reinforcing panels 29, 33 and 30, 34 at each corner of the blank in face-to-face relationship. This arrangement also places the score line sets 40 in panels 33 and 34 in position for the next folding step about score lines 38 and 39.

Figure 4:
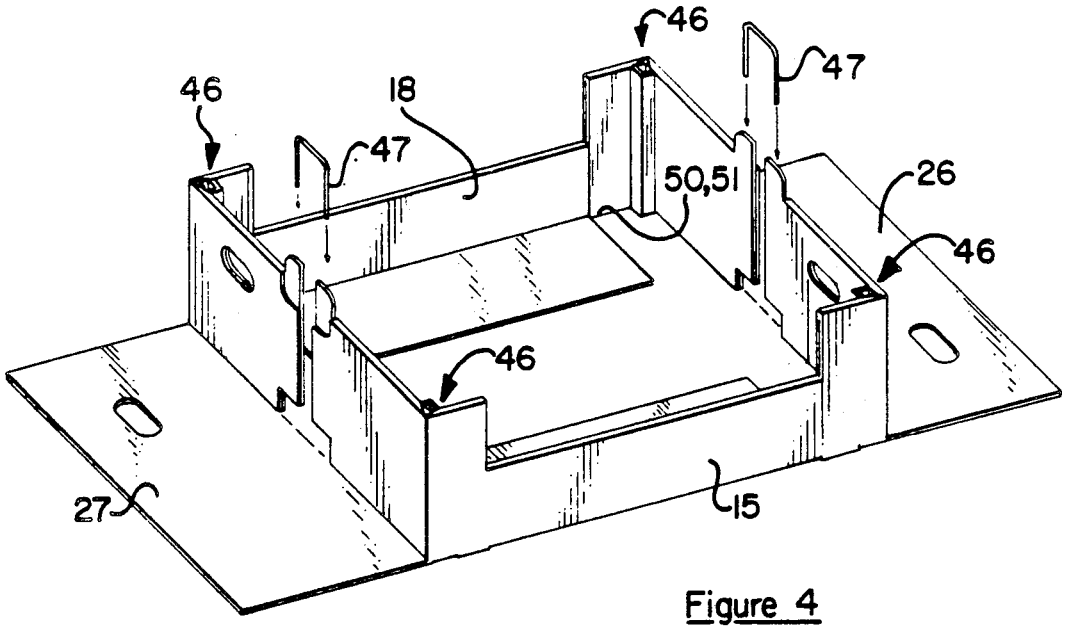
FIG. 4 is a perspective view as in FIG. 3 showing a third folding step.

The score line sets 40 are arranged alternately on the inside and outside surfaces of the panels 33, 34 to automatically produce the corner posts 46 at each corner of the tray when the reinforcing panel pairs 30, 34 and 29, 33 at each end of the blank are folded inwardly about score lines 38, 39 as shown in FIG. 4. These joined panels with their integral tabs 37 sticking upwardly are temporarily secured together by U-shaped brackets 47 which fit within the exposed corrugations of the blank material. The tray is completed by folding the end walls 26, 27 adjacent to the outer exposed surfaces of the reinforcing panels 29 and 30 at each end of the tray where they are glued in place as shown in FIG. 5

FIG. 5 illustrates a completed tray with its reinforced end walls 29, 33 and 30, 34 and reinforced side walls 14, 18 and 15, 19. The bottom wall 11 is partially reinforced by the panels 22, 23 which lie on top of bottom wall 11. The side walls 14, 15 are partially cut away to provide recessed portions for access to the trays when they are stacked as shown in FIG. 6. Meanwhile the upstanding tabs 37 on the reinforced end walls of one tray are arranged to cooperate with bottom wall slots 24, 25 in another tray when the trays are stacked. To give the stacked trays further rigidity the end walls 26, 27 are cut so that their height is slightly taller than the height of the tabs 37 on reinforcing panels 29, 33 and 30, 34. This extra height permits top portions of the end walls 26 and 27 of a first tray to overlap and grip the ends of the a second tray placed on top of the first tray. This insures that the stacked trays will have extra stability in addition to their extra strength.

Accordingly it may be seen that the tray of the present invention is prepared from a single blank of paperboard, preferably corrugated paperboard, wherein there is essentially no wasted material. The blank is generally rectangular in shape to provide a final product of rectangular shape. The end wall reinforcing flaps include sections which extend over the ends of the side walls to provide reinforcement and also include sets of alternating scored lines which automatically produce corner posts at each corner of the tray when the reinforcing flaps are folded into position. The novel arrangement of the parts of the tray permit the construction of the tray at the point of use where it may be stacked with other trays to provide a point-of-purchase display or for other related uses.

It will be understood that mere changes in construction to produce different embodiments of the invention may suggest themselves to those skilled in the art without departing from the spirit and scope of this invention as defined in the appended claims.

What is claimed is:

1. A stackable tray with reinforced corners prepared from a single blank of material comprising:

(a) a substantally centrally located bottom panel of generally rectangular shape having side and end walls foldably attached to the edges thereof said side walls having recessed portions centrally located therein and elevated portions at each end thereof;

(b) a first pair of side wall reinforcing panels foldably attached to the recessed sections of said side walls;

(c) a pair of bottom wall reinforcing panels foldably attached to the ends of said first pair of side wall reinforcing panels and arranged to extend a partial distance across said bottom panel; and, (d) a set of end wall reinforcing panels located at each corner of the blank adapted to be folded into position inside said tray end walls, each set comprising a first panel foldably attached to the elevated portion of the adjacent side wall at each corner and a second panel foldably attached to the first panel, said second panel including a first part which overlaps and reinforces the elevated portion of the adjacent side wall, a second part which is scored to automatically form integral corner posts at each corner of the bottom panel when the end wall reinforcing panels are folded into position and a third part that overlaps the first panel of each end wall reinforcing set.

2. The tray of claim 1 wherein the first pair of side wall reinforcing panels are adhered to the recessed portions of the tray side walls and the sets of end wal reinforcing panels are held in face-to-face relation by inserting tabs provided on the first part of each second panel in each end wall reinforcing set into slots provided along the edge of the bottom wall adjacent to the fold line between the side walls and the bottom wall.

3. The tray of claim 2 wherein the scored lines of the second part of the second panel of each end wal reinforcing set are applied alternately to the inner and outer surfaces of the blank material equally spaced from one another to provide forward and reverse folds which automatically produce two interior legs of a corner post at each corner of the bottom panel between the first and third parts of the second panel of each end wall reinforcing set.

4. The tray of claim 3 wherein the third part of the second panel of each end wall reinforcing set includes a tab element which extends above the nominal height of each end wall reinforcing set and which is located at the end thereof remote from its related corner post for the purpose of providing a means for temporarily retaining the end wall reinforcing sets at each end of the bottom wall in a igned position during the set up of the tray and for maintaining the stability of a stack of trays.

5. The tray of claim 4 wherein the means for retaining the end wall reinforcing sets in aligned relation comprises U shaped brackets that engage the adjacent tab elements of the end wall reinforcing sets at each end of the bottom wall.

6. The tray of claim 5 wherein the means for maintaining the stability of a stack of trays comprises the combination of the said tab elements and slots provided at the ends of the bottom panel located along the fold lines separating the end walls from the bottom panel.

7. The tray of claim 6 wherein the end walls of the tray are adhered to the outer surfaces of the first panels of each end wall reinforcing set at each end of the tray and the end walls have a nominal height above the bottom panel slightly greater than the nominal height of the tab elements included on the third part of the second panel of each end wall reinforcing set.

8. The tray of claim 7 wherein aligned handhole cut outs are provided in the end walls and the end wall reinforcing sets at diagonally opposite ends of the tray.

9. The tray of claim 8 wherein the blank is constructed from corrugated paperboard and the corrugations in the blank are aligned to increase vertical stacking strength.

* * * * *